US008598075B2

(12) United States Patent
Ochiai et al.

(10) Patent No.: US 8,598,075 B2
(45) Date of Patent: Dec. 3, 2013

(54) THERMAL RECORDING MATERIAL AND METHOD FOR PRODUCING THE SAME

(75) Inventors: Takahito Ochiai, Tokyo (JP); Takao Masuda, Tokyo (JP)

(73) Assignee: Mitsubishi Paper Mills Limited, Tokyo (JP)

( * ) Notice: Subject to any disclaimer, the term of this patent is extended or adjusted under 35 U.S.C. 154(b) by 208 days.

(21) Appl. No.: 13/132,984

(22) PCT Filed: Dec. 21, 2009

(86) PCT No.: PCT/JP2009/071221

§ 371 (c)(1), (2), (4) Date: Jul. 22, 2011

(87) PCT Pub. No.: WO2010/074018

PCT Pub. Date: Jul. 1, 2010

(65) Prior Publication Data

US 2011/0287930 A1 Nov. 24, 2011

(30) Foreign Application Priority Data

Dec. 26, 2008 (JP) ..... 2008-331878
Jun. 17, 2009 (JP) ..... 2009-143962

(51) Int. Cl.
*B41M 5/44* (2006.01)

(52) U.S. Cl.
USPC ..... 503/214; 427/152; 503/226

(58) Field of Classification Search
CPC ..... B41M 5/44
See application file for complete search history.

(56) References Cited

U.S. PATENT DOCUMENTS

| | | | |
|---|---|---|---|
| 4,467,336 | A | 8/1984 | Koike |
| 5,061,677 | A | 10/1991 | Yoshida et al. |
| 6,346,570 | B1 | 2/2002 | Kazuyuki et al. |

FOREIGN PATENT DOCUMENTS

| | | |
|---|---|---|
| JP | 59-11287 | 1/1984 |
| JP | 2-158382 | 6/1990 |
| JP | 2001-138637 | 5/2001 |
| JP | 2007-313822 | 6/2007 |

*Primary Examiner* — Bruce H Hess
(74) *Attorney, Agent, or Firm* — Fitzpatrick, Cella, Harper & Scinto

(57) ABSTRACT

Provided is a thermal recording material comprising a heat-sensitive recording layer for color formation by heat and a protective layer stacked in this order on a support, the heat-sensitive recording layer containing an ethylene-vinyl alcohol copolymer, the protective layer containing a diacetone-modified polyvinyl alcohol and a crosslinker.

8 Claims, No Drawings

THERMAL RECORDING MATERIAL AND METHOD FOR PRODUCING THE SAME

TECHNICAL FIELD

The present invention relates to a thermal recording material and a method for producing the same.

BACKGROUND ART

Generally, a thermal recording material comprises, on a support, a heat-sensitive recording layer containing, as main components, an electron-donating dye precursor, which is usually colorless or light-colored, and an electron-accepting compound. By application of heat to such a thermal recording material with a thermal head, a thermal stylus, laser beam, etc., an instant reaction between the electron-donating dye precursor and the electron-accepting compound serving as a color developer occurs and thereby a recorded image is produced thereon. Such a thermal recording material is advantageous, for example, in that records can be made thereon with a relatively simple device ensuring easy maintenance and no noise generation. Therefore, thermal recording materials are widely used for a measuring recorder, a facsimile, a printer, a computer terminal, a label printer, a ticket machine for passenger tickets or other tickets, and the like. Particularly in recent years, thermal recording materials are used as receipts of gas, water, electricity and other bill payments, billing statements issued from ATMs at financial institutions, various receipts, public lotteries, thermal recording labels or tags for point of sales (POS) system, etc.

With the diversification of the application of thermal recording materials as set forth above, applications involving print processing have increased. In recent years, strongly desired from the market is a thermal recording material comprising a protective layer that is suitable for print processing in terms of surface strength and has such an excellent solvent barrier property as to prevent color development of the background caused by a solvent for printing, so-called background fogging. More recently, in particular, with the advance of recording systems, thermal recording materials are used in severer conditions. Under conditions such as outdoors and high humidity, thermal recording materials may become wet and stick together (hereinafter, referred to as wet-blocking). To avoid this, a thermal recording material comprising a protective layer with an excellent water resistance is also strongly desired. Further, the frequency of printing on thermal recording materials is increasing, and in a printer with an automatic cutter, powder spill from the coating layers (a heat-sensitive recording layer, a protective layer, etc.) of a thermal recording material upon cutting operation may have a serious effect on, for example, the feeding of the thermal recording material. Therefore, thermal recording materials less prone to powder spill are also desired.

For providing a protective layer of a thermal recording material with a surface strength suitable for print processing and such an excellent solvent barrier property as to prevent color development of the background caused by a solvent for printing, various constitutions containing a modified polyvinyl alcohol resin etc. as a resin for a protective layer and a heat-sensitive recording layer are proposed. For example, Patent Literature 1 describes the use of, as a binder, a random copolymer of a polyvinyl alcohol monomer unit and an ethylene monomer unit in a heat-sensitive recording layer and a protective layer. This method is successful in providing a high surface strength, but the solvent barrier property of the protective layer is insufficient and the water resistance is insufficient. Patent Literature 2 describes the use of, as a binder, PVA having an ethylene unit and a silanol group in a heat-sensitive recording layer and a protective layer. This method is successful in providing an excellent surface strength and solvent barrier property, but the water resistance of the protective layer is poor since the binder has a highly hydrophilic silanol group.

For providing a protective layer of a thermal recording material with an excellent water resistance, various constitutions containing an acrylic resin or a modified polyvinyl alcohol resin as a resin for a protective layer are proposed. For example, Patent Literature 3 describes the use of, as an acrylic resin, a core-shell type aqueous emulsion containing an acrylic copolymer in a core and a (meth)acrylamide copolymer in a shell, and this method is successful in providing the protective layer with a high water resistance. However, since an acrylic resin having a high glass transition point is used for the protective layer of the thermal recording material in pursuit of resistance to a thermal head, the protective layer is naturally hard and fragile. Therefore, such a protective layer is prone to powder spill upon cutting operation, and also unsuitable for print processing in terms of surface strength. As a protective layer containing a modified polyvinyl alcohol resin, for example, Patent Literature 4 and 5 each describe the one containing a water-resistant diacetone-modified polyvinyl alcohol and a crosslinker. These conventional methods are successful in providing the surface of the protective layer with a good water resistance, but the protective layer has an insufficient wet-blocking resistance due to weak adhesion to the underlayer, and is also prone to powder spill upon cutting operation. Patent Literature 6 describes a thermal recording body produced by using, as a modified polyvinyl alcohol, an acetoacetyl-modified polyvinyl alcohol etc. in a protective layer, and adjusting the environmental temperature and moisture. This method is successful in increasing the water resistance, but results in much powder spill and red-yellow tint of the protective layer.

As described above, conventional methods aiming for high surface strength tend to make the coating layer more hydrophilic, and therefore fail to sufficiently improve the water resistance. On the other hand, methods aiming for high water resistance tend to make the coating layer hard and fragile, and therefore fail to sufficiently improve the surface strength and to sufficiently reduce powder spill upon cutting operation.

CITATION LIST

Patent Literature

Patent Literature 1: JP-A 9-66666
Patent Literature 2: JP-A 2004-106229
Patent Literature 3: JP-A 5-69665
Patent Literature 4: JP-A 11-314457
Patent Literature 5: JP-A 2002-283717
Patent Literature 6: JP-A 9-164763

SUMMARY OF INVENTION

Technical Problem

An object of the present invention is to provide a solution to the problems described above, namely to provide a thermal recording material that is suitable for print processing in terms of surface strength and solvent barrier property, has an excellent wet-blocking resistance and is less prone to powder spill upon cutting operation, and further to provide a method for producing the same.

Solution to Problem

As a result of intensive research, the present inventors invented a thermal recording material capable of solving the above-mentioned problems, namely a thermal recording material comprising a heat-sensitive recording layer for color formation by heat and a protective layer stacked in this order on a support, the heat-sensitive recording layer containing an ethylene-vinyl alcohol copolymer, the protective layer containing a diacetone-modified polyvinyl alcohol and a crosslinker. The ethylene-vinyl alcohol copolymer has a high affinity for the diacetone-modified polyvinyl alcohol and strongly binds thereto. Such strong binding formed in the interface of the heat-sensitive recording layer and the protective layer increases adhesion between both layers. Therefore, the surface strength of the thermal recording material is high and excellent in printability. Further, since a diacetone-modified polyvinyl alcohol and a crosslinker are contained in the protective layer, a crosslinking reaction via a diacetone-modified group provides the surface of the protective layer with an increased water resistance. Also, since the diacetone-modified polyvinyl alcohol contained in the protective layer strongly binds to the ethylene-vinyl alcohol copolymer in the heat-sensitive recording layer, a tough coat is formed and therefore the protective layer is excellent in solvent barrier property and wet-blocking resistance. Furthermore, since the protective layer strongly adheres to the heat-sensitive recording layer, and the coat formed as the protective layer is tough and flexible, the thermal recording material is less prone to powder spill upon cutting operation.

The present inventors found that, in the production of the thermal recording material, a thermal recording material that has a further increased wet-blocking resistance and is further less prone to powder spill can be obtained by applying and drying a coating solution for forming the protective layer on the heat-sensitive recording layer formed on the support, the coating solution containing a diacetone-modified polyvinyl alcohol and a crosslinker; and keeping the overall water content of a thus-obtained layered product, which comprises the heat-sensitive recording layer and the protective layer stacked on the support, at 6% or higher but lower than 12%. Since the presence of water allows the crosslinking reaction of the diacetone-modified polyvinyl alcohol and the crosslinker to proceed not in limited areas, but uniformly all over the protective layer after the coating and drying steps, the protective layer has no color tint and is highly water resistant and tough, and therefore the thermal recording material has a further increased wet-blocking resistance and is further less prone to powder spill.

Further, a thermal recording material that has a more excellent wet-blocking resistance and is further less prone to powder spill can be obtained by applying and drying a coating solution for forming the protective layer on the heat-sensitive recording layer formed on the support, the coating solution containing a diacetone-modified polyvinyl alcohol and a crosslinker; and keeping the overall water content of a thus-obtained layered product, which comprises the heat-sensitive recording layer and the protective layer stacked on the support, at 6% or higher but lower than 8% for 24 hours or longer, or at 9% or higher but lower than 11% for 1 hour or longer.

According to the present invention, the ethylene-vinyl alcohol copolymer content of the heat-sensitive recording layer may be 15 mass % or higher relative to the total solid content of the heat-sensitive recording layer. In this case, the ethylene-vinyl alcohol copolymer can more effectively bind to the diacetone-modified polyvinyl alcohol in the interface of the heat-sensitive recording layer and the protective layer, and thereby increases adhesion between both layers. As a result, the thermal recording material has a further increased surface strength and is further less prone to powder spill.

The ethylene-vinyl alcohol copolymer contained in the heat-sensitive recording layer may have an average polymerization degree of 500 or higher but lower than 4,000, and a saponification degree of 90% or higher but lower than 99%. In this case, the ethylene-vinyl alcohol copolymer increases the strength of the heat-sensitive recording layer itself. Also, such an ethylene-vinyl alcohol copolymer further more effectively binds to the diacetone-modified polyvinyl alcohol in the interface with the protective layer, thereby further increasing adhesion between the heat-sensitive recording layer and the protective layer. Therefore, the thermal recording material has a further increased surface strength and is further less prone to powder spill.

According to the present invention, kaolin may be contained in the protective layer. In this case, the tabular structure of kaolin acts effectively on adhesion between the heat-sensitive recording layer and the protective layer, that is, kaolin increases the contact between the ethylene-vinyl alcohol copolymer and the diacetone-modified polyvinyl alcohol, and thereby can further increase the surface strength of the protective layer. Also, since kaolin in the protective layer prevents water from permeating into the heat-sensitive recording layer during the coating and drying steps for forming the protective layer, and enables prolonged retention of water in the protective layer, the formed coat has crosslinks more evenly, and therefore the thermal recording material has a further increased solvent barrier property and wet-blocking resistance, and is further less prone to powder spill.

The protective layer may contain kaolin and silica. In this case, since kaolin increases the surface strength and silica increases the flexibility of the coat formed as the protective layer, the thermal recording material is further less prone to powder spill. Also, due to its high water absorbability, silica can absorb water on the surface of the thermal recording material (such water may cause wet-blocking), and therefore the thermal recording material has a further increased wet-blocking resistance.

Advantageous Effects of Invention

As described above, the present invention can provide a thermal recording material that has a high surface strength and solvent barrier property and thus is excellent in printability, is free from color tint, has an excellent wet-blocking resistance and is less, prone to powder spill upon cutting operation. The present invention can also provide a method for producing the same.

DESCRIPTION OF EMBODIMENTS

Hereinafter, the present invention will be described in more detail.

The thermal recording material of the present invention comprises, on a support, a heat-sensitive recording layer for color formation by heat and, on the heat-sensitive recording layer, at least one protective layer.

The heat-sensitive recording layer of the present invention contains an ethylene-vinyl alcohol copolymer at least, and the protective layer contains a diacetone-modified polyvinyl alcohol and a crosslinker at least. The ethylene-vinyl alcohol copolymer has an extremely good affinity for the diacetone-modified polyvinyl alcohol and strongly binds thereto. Although the reason is unclear, a possible theory is that between both compounds each having a hydrophilic moiety and a hydrophobic moiety in a molecule, hydrophilic moieties and hydrophobic moieties bind to each other to produce strong adhesion in the interface. Therefore, inclusion of an ethylene-vinyl alcohol copolymer in the heat-sensitive recording layer and inclusion of a diacetone-modified polyvinyl alcohol in the protective layer provide strong adhesion in the interface between both layers, and the resulting thermal recording material has an excellent surface strength and is less prone to powder spill upon cutting operation.

The protective layer of the present invention containing a diacetone-modified polyvinyl alcohol and a crosslinker usually contains a crosslinked product of the diacetone-modified polyvinyl alcohol and the crosslinker. The thermal recording material comprising a protective layer containing a crosslinked product of a diacetone-modified polyvinyl alcohol and a crosslinker is one of the preferable embodiments of the present invention.

The thermal recording material of the present invention can be produced, for example, by applying and drying a coating solution for forming a heat-sensitive recording layer on a support, the coating solution containing an ethylene-vinyl alcohol copolymer, and then a coating solution for forming a protective layer, the coating solution containing a diacetone-modified polyvinyl alcohol and a crosslinker. A thus-obtained layered product comprising a heat-sensitive recording layer and a protective layer stacked on a support can be used as the thermal recording material of the present invention. In the method for producing the thermal recording material of the present invention, it is preferred that, after a coating solution for forming a protective layer is applied and dried on a heat-sensitive recording layer formed on a support, the overall water content of a thus-obtained layered product comprising the heat-sensitive recording layer and the protective layer stacked on the support is kept at 6% or higher but lower than 12%.

Therefore, one aspect of the present invention features a method for producing a thermal recording material comprising a heat-sensitive recording layer for color formation by heat and a protective layer stacked successively on a support, the method comprising the steps of applying and drying a coating solution for forming the protective layer on the heat-sensitive recording layer formed on the support, the coating solution containing a diacetone-modified polyvinyl alcohol and a crosslinker; and keeping the overall water content of a thus-obtained layered product, which comprises the heat-sensitive recording layer and the protective layer stacked on the support, at 6% or higher but lower than 12%. This method is suitable as a method for producing the thermal recording material of the present invention.

The protective layer of the present invention is preferably produced as described above, that is, by applying and drying, on the heat-sensitive recording layer, an aqueous coating solution containing a diacetone-modified polyvinyl alcohol and a crosslinker, and then keeping the overall water content of the layered product, which comprises the support and the different layers, at 6% or higher but lower than 12%. The progress of the crosslinking reaction of the diacetone-modified polyvinyl alcohol and the crosslinker is slow in the aqueous coating solution, but in the process of applying and drying the aqueous coating solution on the heat-sensitive recording layer, an increased contact of both compounds promotes the reaction. However, since both compounds change into a solid form at the very end of the drying step, the reaction may be impeded and fail to provide a sufficient water resistance. Also, this change may confine the reaction to limited areas in the layer and result in a partially hard and fragile layer. For these reasons, uniform progress of the crosslinking reaction all over the layer requires mediation of a certain amount of water even after the drying step. Thus, the overall water content of the layered product comprising the support and the different layers is extremely important. Further, the presence of water contributes more dominantly in the reaction of a diacetone group and a crosslinker than in the reaction of another modifying group and a crosslinker, resulting in a mild and uniform progress of the reaction. Furthermore, unlike an acetoacetyl group, the diacetone group characteristically causes no red-yellow tint through the crosslinking reaction and gives excellent whiteness to the thermal recording material as a whole.

As described above, in the production of the thermal recording material of the present invention, by keeping the overall water content of the layered product, which comprises the heat-sensitive recording layer and the protective layer stacked on the support, at 6% or higher but lower than 12% after the coating and drying steps for forming the protective layer, uniform progress of the crosslinking reaction all over the protective layer can be achieved even after the drying step. As a result, the protective layer has an increased water resistance and flexibility, and the thermal recording material has a more excellent wet-blocking resistance and is less prone to powder spill. In the case where the water content is kept at lower than 6%, the mediation of water on the reaction may be insufficient, and as a result, the thermal recording material may have a decreased wet-blocking resistance and be more prone to powder spill. In the case where the water content after the drying step is 12% or higher, the thermal print quality may be deteriorated. Further, keeping the water content at 12% or higher is industrially difficult, and in the case of the roll-to-roll production, such a high water content may cause wet-blocking of the back and front surfaces of the thermal recording material. The overall water content of the layered product is more preferably kept at 6% or higher but lower than 11%. The lower limit of the overall water content of the layered product is more preferably 6.5%.

According to the present invention, there is no particular limitation on the duration of keeping the overall water content of the layered product comprising the support and the different layers at 6% or higher but lower than 12% after the coating and drying steps for forming the protective layer, as long as the effects of the present invention can be achieved. Preferred is 1 hour or longer. It is particularly preferred that the overall water content is kept at 6% or higher but lower than 8% for 24 hours or longer, or at 9% or higher but lower than 11% for 1 hour or longer. In either case, a thermal recording material more excellent in wet-blocking resistance and powder spill prevention can be obtained. In the case where the water content is kept at 8% or higher for 24 hours or longer, a thermal recording material excellent in wet-blocking resistance and powder spill prevention can be obtained, but since rolled materials may easily become loose, productivity may be slightly decreased. In the case where the water content is kept at lower than 9% for 1 hour or longer but shorter than 24 hours, a thermal recording material excellent in wet-blocking resistance and powder spill prevention can be obtained, and such performances increase as the duration becomes longer, but stay fairly constant after 24 hours. According to the present invention, the temperature during keeping the prescribed water content is not particularly limited, but is preferably about 15 to 35° C. since this temperature range allows the crosslinking reaction to uniformly proceed. Excessively high temperature makes the crosslinking reaction rapidly proceed, and may deteriorate the thermal recording material in terms of powder spill prevention. On the other hand, excessively low temperature may require a longer time for a sufficient wet-blocking resistance.

The above-prescribed water content in the production of the thermal recording material is also effective for the heat-sensitive recording layer, in particular the ethylene-vinyl alcohol copolymer. By the action of the water on the ethylene-vinyl alcohol copolymer in the heat-sensitive recording layer, a tougher coat is formed and a more flexible heat-sensitive recording layer can be obtained. Also, the water further promotes binding of the ethylene-vinyl alcohol copolymer with the diacetone-modified polyvinyl alcohol, and therefore, the thermal recording material has a more excellent surface strength and is further less prone to powder spill.

According to the present invention, the water content refers to the ratio of water contained in a layered product as a whole after the coating and drying steps for forming a heat-sensitive recording layer and a protective layer on a support in the production of the thermal recording material, the layered product comprising the support and the different layers. The water content can be measured by use of the method specified in JIS P8127 and a measuring instrument (a near-infrared moisture meter etc.) standardized in the method.

According to the present invention, the method for keeping the water content of the layered product at 6% or higher but lower than 12% is not particularly limited. For example, in the case of a sheeted thermal recording material, the equilibrium water content of the entire sheet can be retained by adjusting the relative humidity (RH) in the environment for preservation. In the case of a rolled thermal recording material, the water content inside the roll can be retained by adjusting the water content according to any method before take-up and subsequently making a roll. Also, the water content can be retained by sealed packaging etc.

Industrially, thermal recording materials are often manufactured by the roll-to-roll technology. In this case, usually, after the coating and drying steps for forming a heat-sensitive recording layer and a protective layer, the obtained thermal recording material (layered product) is taken up into a roll. The water content of the layered product at the point of take-up is controllable by adjusting the drying conditions at the drying step etc., and is usually adjusted to 4 to 5% in consideration of time-dependent loosening in the roll etc. According to the present invention, by adjusting the water content at the point of take-up at 6% or higher but lower than 12%, the water content of the layered product can be kept at a prescribed value. For the solution of loosening in the roll etc., drying and rerolling may be performed after keeping the prescribed water content for a certain time. Another solution is to make a short roll with the water content being 6% or higher but lower than 12% since short rolls hardly become loose.

The ethylene-vinyl alcohol copolymer of the present invention refers to a compound having an ethylene unit introduced into the main-chain backbone of polyvinyl alcohol. Regarding the ethylene-vinyl alcohol copolymer, the polymerization degree, the saponification degree and the degree of introduction of an ethylene unit are not particularly limited as long as the effects of the present invention can be achieved. In view of solubility, spreadability, water resistance of the coat, layer strength and the like, the degree of introduction of an ethylene unit is preferably 1 to 20 mol %. Particularly preferably, the introduction degree is 5 to 10 mol % for a good solubility and layer strength, and a good water resistance of the coat.

The ethylene-vinyl alcohol copolymer content of the heat-sensitive recording layer is preferably 15 mass % or higher, and more preferably 17 mass % or higher but lower than 25 mass % relative to the total solid content of the heat-sensitive recording layer. In the case where the content is 15 mass % or higher, a sufficient amount of the ethylene-vinyl alcohol copolymer is exposed at the interface between the protective layer and the heat-sensitive recording layer and strongly binds to the diacetone-modified polyvinyl alcohol contained in the protective layer. Thus, the thermal recording material has an excellent surface strength and is less prone to powder spill. In the case where the content is 17 mass % or higher, a further increased amount of the ethylene-vinyl alcohol copolymer is exposed at the interface and strongly binds to the diacetone-modified polyvinyl alcohol. Thus, the thermal recording material has a further increased surface strength and is further less prone to powder spill. In the case where the ethylene-vinyl alcohol copolymer content is 25 mass % or higher relative to the total solid content of the heat-sensitive recording layer, the coloring sensitivity of the heat-sensitive recording layer may be decreased. In the case where the ethylene-vinyl alcohol copolymer content is lower than 15 mass %, the thermal recording material may be deteriorated in terms of surface strength and powder spill prevention.

Further, the average polymerization degree of the ethylene-vinyl alcohol copolymer is preferably 500 or higher but lower than 4,000. The ethylene-vinyl alcohol copolymer with an average polymerization degree of 500 or higher has sufficiently long molecular chains, and by entwinement of the chains with each other, a coat with an increased strength can be formed. Thus, the strength of the heat-sensitive recording layer itself is increased. Since the ethylene-vinyl alcohol copolymer with an average polymerization degree of lower than 4,000 has a good water solubility, the copolymer can be uniformly distributed all over the heat-sensitive recording layer, resulting in less unevenness in the layer. Thus, the strength of the heat-sensitive recording layer itself is increased. The average polymerization degree is more preferably 1,000 or higher but lower than 2,000. In this range, the strength of the heat-sensitive recording layer itself is further increased and thereby the thermal recording material has a further increased surface strength. In the case where the average polymerization degree is lower than 500, due to decreasing tendency in the strength of the heat-sensitive recording layer itself, the thermal recording material may have an unfavorable surface strength. In the case where the average polymerization degree is 4,000 or higher, the ethylene-vinyl alcohol copolymer tends to have a lower water solubility and a higher solution viscosity, and thereby coating operability may be poor. The average polymerization degree can be measured according to the test method specified in JIS K6726.

Furthermore, the ethylene-vinyl alcohol copolymer preferably has a saponification degree of 90% or higher but lower than 99%. Such an ethylene-vinyl alcohol copolymer can provide the protective layer with a good solvent barrier property, increase the surface strength and the wet-blocking resistance, and reduce powder spill. More preferably, the ethylene-vinyl alcohol copolymer has a saponification degree of 95% or higher but lower than 99%. Such an ethylene-vinyl alcohol copolymer can further increase the surface strength and the wet-blocking resistance, and further reduce powder spill. Although the reason is unclear, possible theories are as follows. Firstly, the ethylene-vinyl alcohol copolymer with a saponification degree of 90% or higher has a high crystallinity and can form a high-density coat after the drying step. Thus, while a coating solution for forming the protective layer is applied and dried, the coating solution is prevented from unnecessary permeation into the heat-sensitive recording layer. Therefore, the protective layer can be provided with a good solvent barrier property. Secondly, since a higher crystallinity increases the coat strength and the wet-blocking resistance, the surface strength and the wet-blocking resistance after formation of the protective layer are increased. Since the ethylene-vinyl alcohol copolymer with a saponification degree of 95% or higher has a higher crystallinity, the ethylene-vinyl alcohol copolymer can provide the protective layer with a better solvent barrier property, and further increase the surface strength and the wet-blocking resistance. Since the ethylene-vinyl alcohol copolymer with a saponification degree of 99% or higher has an excessively high crystallinity, the formed coat may be less flexible and thereby hard and fragile. Therefore, the thermal recording material may be more prone to powder spill. Since the ethylene-vinyl alcohol copolymer with a saponification degree of lower than 90% has a lower water solubility, complete dissolution may require prolonged heating and stirring. Such a requirement decreases productivity of the thermal recording material and may be disadvantageous in the production. The saponification degree can be measured according to the test method specified in JIS K6726.

The electron-donating compound which is contained as a dye precursor in the heat-sensitive recording layer and is usually colorless or light-colored is not particularly limited, and is typified by substances generally used in pressure-sensitive recording materials and thermal recording materials.

Specific examples of the dye precursor include the following:

(1) Triarylmethane Compounds 3,3-bis(p-dimethylaminophenyl)-6-dimethylamino-phthalide (crystal violet lactone),
3,3-bis(p-dimethylaminophenyl)phthalide,
3-(p-dimethylaminophenyl)-3-(1,2-dimethylindol-3-yl)-phthalide,
3-(p-dimethylaminophenyl)-3-(2-methylindol-3-yl)phthalide,
3-(p-dimethylaminophenyl)-3-(2-phenylindol-3-yl)phthalide,
3,3-bis(1,2-dimethylindol-3-yl)-5-dimethylamino-phthalide,
3,3-bis(1,2-dimethylindol-3-yl)-6-dimethylamino-phthalide,
3,3-bis(9-ethylcarbazol-3-yl)-5-dimethylamino-phthalide,
3,3-bis(2-phenylindol-3-yl)-5-dimethylamino-phthalide,
3-(p-dimethylaminophenyl)-3-(1-methylpyrrol-2-yl)-6-dimethylamino-phthalide, and the like;

(2) Diphenylmethane Compounds 4,4'-bis(dimethylaminophenyl)benzhydrylbenzyl ether,
N-chlorophenylleucoauramine,
N-2,4,5-trichlorophenylleucoauramine, and the like;

(3) Xanthene Compounds rhodamine B anilinolactam, rhodamine B-p-chloroanilinolactam,
3-diethylamino-7-dibenzylaminofluoran,
3-diethylamino-7-octylaminofluoran,
3-diethylamino-7-phenylfluoran,
3-diethylamino-7-chlorofluoran,
3-diethylamino-6-chloro-7-methylfluoran,
3-diethylamino-6-methyl-7-(3-methylphenylamino)fluoran,
3-diethylamino-7-(3,4-dichloroanilino)fluoran,
3-dibutylamino-7-(2-chloroanilino)fluoran,
3-diethylamino-7-(2-chloroanilino)fluoran,
3-diethylamino-6-methyl-7-anilinofluoran,
3-dibutylamino-6-methyl-7-anilinofluoran,
3-dipentylamino-6-methyl-7-anilinofluoran,
3-(N-ethyl-N-tolyl)amino-6-methyl-7-anilinofluoran,
3-piperidino-6-methyl-7-anilinofluoran,
3-(N-ethyl-N-tolyl)amino-6-methyl-7-phenethylfluoran,
3-diethylamino-7-(4-nitroanilino)fluoran,
3-(N-methyl-N-propyl)amino-6-methyl-7-anilinofluoran,
3-(N-ethyl-N-isoamyl)amino-6-methyl-7-anilinofluoran,
3-(N-methyl-N-cyclohexyl)amino-6-methyl-7-anilinofluoran,
3-(N-ethyl-N-tetrahydrofurfuryl)amino-6-methyl-7-anilinofluoran,
3-diethylamino-6-methyl-7-(3-trifluoromethylanilino)fluoran, and the like;

(4) Thiazine Compounds benzoyl leucomethylene blue, p-nitrobenzoyl leucomethylene blue, and the like; and (5) Spiro Compounds 3-methyl spirodinaphthopyran, 3-ethyl spirodinaphthopyran,
3,3'-dichlorospirodinaphthopryan,
3-benzylspirodinaphthopyran,
3-methylnaphtho-(3-methoxybenzo)spiropyran,
3-propylspirobenzopyran, and the like. If needed, these dye precursors can be used alone or as a mixture of two or more kinds thereof.

The electron-accepting compound contained as a color developer in the heat-sensitive recording layer is not particularly limited, and may be, for example, any acidic substance generally used in pressure-sensitive recording materials and thermal recording materials. Examples thereof include phenol derivatives, aromatic carboxylic acid derivatives, N,N'-diarylthiourea derivatives, arylsulfonylurea derivatives, polyvalent metal salts such as zinc salts of an organic compound, benzenesulfonamide derivatives and urea-urethane compounds.

Specific examples of the electron-accepting compound contained in the heat-sensitive recording layer are listed below, but are not necessarily limited to the following compounds. These compounds may be used alone or in combination of two or more kinds thereof.

4-hydroxy-4'-isopropoxy diphenylsulfone, 4-hydroxy-4'-n-propoxy diphenylsulfone, 4,4'-dihydroxy diphenylsulfone, 2,4'-dihydroxy diphenylsulfone, 4-hydroxy diphenylsulfone, 4-hydroxy-4'-methyl diphenylsulfone, 4-hydroxy-4'-methoxy diphenylsulfone, 4-hydroxy-4'-ethoxy diphenylsulfone, 4-hydroxy-4'-n-butoxy diphenylsulfone, 4-hydroxy-4'-benzyloxy diphenylsulfone, bis(4-hydroxyphenyl)sulfone monoallyl ether, bis(3-allyl-4-hydroxyphenyl)sulfone, bis(3,5-dibromo-4-hydroxyphenyl)sulfone, bis(3,5-dichloro-4-hydroxyphenyl)sulfone, 3,4-dihydroxy diphenylsulfone, 3,4-dihydroxy-4'-methyl diphenylsulfone, 3,4,4'-trihydroxy diphenylsulfone, 4,4'-[oxybis(ethyleneoxy-p-phenylenesulfonyl)]diphenol, 3,4,3',4'-tetrahydroxy diphenylsulfone, 2,3,4-trihydroxy diphenylsulfone, 3-phenylsulfonyl-4-hydroxy diphenylsulfone, 2,4-bis(phenylsulfonyl)phenol, α-{4-[(hydroxyphenyl)sulfonyl]phenyl}-ω-hydroxy-poly(oxyethylene/oxyethylene/oxy-p-phenylenesulfonyl-p-phenylene) (polymerization degree: n=1 to 7), 4-phenylphenol, 4-hydroxyacetophenone, 1,1-bis(4-hydroxyphenyl)propane, 1,1-bis(4-hydroxyphenyl)pentane, 1,1-bis(4-hydroxyphenyl)hexane, 1,1-bis(4-hydroxyphenyl)cyclohexane, 2,2-bis(4-hydroxyphenyl)propane, 2,2-bis(4-hydroxyphenyl)hexane, 1,1-bis(4-hydroxyphenyl)-2-ethylhexane, 2,2-bis(3-chloro-4-hydroxyphenyl)propane, 1,1-bis(4-hydroxyphenyl)-1-phenylethane, 1,3-bis[1-(4-hydroxyphenyl)-1-methylethyl]benzene, 1,3-bis[1-(3,4-dihydroxyphenyl)-1-methylethyl]benzene, 1,4-bis[1-(4-hydroxyphenyl)-1-methylethyl]benzene, 4,4'-dihydroxy diphenyl ether, 3,3'-dichloro-4,4'-dihydroxydiphenyl sulfide, bis(2-hydroxynaphthyl)methane, methyl 2,2-bis(4-hydroxyphenyl)acetate, butyl 2,2-bis(4-hydroxyphenyl)

acetate, 4,4-thiobis(2-tert-butyl-5-methylphenol), dimethyl 4-hydroxyphthalate, benzyl 4-hydroxybenzoate, methyl 4-hydroxybenzoate, benzyl gallate, stearyl gallate, pentaerythritol tetra(4-hydroxybenzoate), pentaerythritol tri(4-hydroxybenzoate), N-butyl-4-[3-(p-toluenesulfonyl) ureido]benzoate, a dehydration-condensation product from a polycondensate of 2,2-bis(hydroxymethyl)-1,3-propanediol and 4-hydroxybenzoic acid, N,N'-diphenylthiourea, 4,4'-bis[3-(4-methylphenylsulfonyl)ureido]diphenylmethane, N-(4-methylphenylsulfonyl)-N'-phenylurea, N-(benzenesulfonyl)-N'-[3-(4-toluenesulfonyloxy)phenyl]urea, N-(4-toluenesulfonyl)-N'-[3-(4-toluenesulfonyloxy)phenyl]-urea, urea-urethane compounds, salicylanilide, 5-chlorosalicylanilide, salicylic acid, 3,5-di-tert-butylsalicylic acid, 3,5-bis(α-methylbenzyl)salicylic acid, 4-[2'-(4-methoxyphenoxy)ethyloxy]salicylic acid, 3-(octyloxycarbonylamino)salicylic acid, or metal salts of these salicylic acid derivatives (for example, zinc salts thereof), N-(4-hydroxyphenyl)-4-toluenesulfonamide, N-(2-hydroxyphenyl)-4-toluenesulfonamide, N-phenyl-4-hydroxybenzenesulfonamide, and the like.

The heat-sensitive recording layer can contain a heat-fusible substance as a sensitizer for improvement in thermal responsiveness. The heat-fusible substance to be used for this purpose has a melting point of preferably 60 to 180° C., and particularly preferably 80 to 140° C.

Specific examples thereof include known heat-fusible substances such as stearamide, N-hydroxymethyl stearamide, N-stearyl stearamide, ethylenebis(stearamide), methylenebis (stearamide), methylol stearamide, N-stearyl urea, benzyl-2-naphthyl ether, m-terphenyl, 4-benzylbiphenyl, 2,2'-bis(4-methoxyphenoxy)diethyl ether, α,α'-diphenoxy-o-xylene, bis(4-methoxyphenyl)ether, diphenyl adipate, dibenzyl oxalate, bis(4-methylbenzyl) oxalate, bis(4-chlorobenzyl) oxalate, dimethyl terephthalate, dibenzyl terephthalate, phenyl benzenesulfonate, bis(4-allyloxyphenyl)sulfone, 1,2-bis (3-methylphenoxy)ethane, 1,2-diphenoxyethane, 4-acetylacetophenone, diphenylsulfone, acetoacetanilides and fatty acid anilides. More preferred are higher fatty acid amides since they also serve as a lubricant.

These compounds may be used alone or in combination of two or more kinds thereof. For sufficient thermal responsiveness, the sensitizer content is preferably 5 to 50 mass % relative to the total solid content of the heat-sensitive recording layer.

If needed, the heat-sensitive recording layer may contain lubricants such as higher fatty acid metal salts, higher fatty acid amides, paraffin, polyolefin, oxidized polyethylene and castor wax for improvement in sticking property etc.; ultraviolet absorbers such as benzophenone or benzotriazole series compounds for improvement in light resistance etc.; surfactants such as high-molecular-weight anionic or nonionic surfactants for improvement in dispersion and spreadability, etc.; and in addition, various kinds of pigments, fluorescent brighteners, color modifiers, defoamants, etc. Also, a moisturizer is preferably contained so that the prescribed water content of the heat-sensitive recording layer can be kept for a certain time. The moisturizer refers to a substance having a high equilibrium water content at 23° C. at a humidity of 65%, a substance hard to dry once water is absorbed therein, or the like. Specific examples thereof include urea compounds such as urea, ethylene urea and thiourea; saccharides such as glucose, maltose and sucrose; diols such as ethylene glycol, diethylene glycol, triethylene glycol and propylene glycol; and absorbent silica. In addition, these compounds supported on another resin or the like can be used.

The heat-sensitive recording layer of the present invention may be a monolayer, or be composed of two or more layers. In the case of the heat-sensitive recording layer composed of two or more layers, respective heat-sensitive recording layers may differ from each other in chemical composition and the like, but preferably, an ethylene-vinyl alcohol copolymer is contained at least in the heat-sensitive recording layer adjacent to the protective layer.

The heat-sensitive recording layer of the present invention can be formed according to a known technique by use of a coating solution for forming a heat-sensitive recording layer. The coating solution is prepared by mixing aqueous dispersions each containing a different finely-ground color former, with an aqueous solution containing an ethylene-vinyl alcohol copolymer and, if needed, an aqueous solution containing another resin etc. Specifically, the coating solution is applied by a technique selected from film press coating, air knife coating, rod blade coating, bar coating, blade coating, gravure coating, curtain coating, extrusion bar coating and the like, and then dried to form the heat-sensitive recording layer. Layer formation can be also achieved, for example, by use of various printers of lithographic type, letterpress type, flexographic type, gravure type, screen type and other types. In particular, in the case of the heat-sensitive recording layer composed of two or more layers, alternate coating and drying for each layer; successive coating and subsequent drying for all the layers (wet-on-wet); or simultaneous coating and subsequent drying for all the layers (simultaneous multilayer coating by slide curtain coating) may be performed. For sufficient thermal responsiveness, the coating amount for forming the heat-sensitive recording layer is preferably 0.05 to 2 $g/m^2$, and more preferably 0.1 to 1 $g/m^2$ in terms of the bone-dry coating amount of the dye precursor. The drying conditions can be appropriately adjusted as far as the heat-sensitive recording layer does not color.

According to the present invention, the diacetone-modified polyvinyl alcohol used for the protective layer is not particularly limited as long as the effects of the present invention can be achieved, but preferred is one with a modification degree of 1 to 10 mol % for a good water solubility and a good wet-blocking resistance of the coat. Further, the diacetone-modified polyvinyl alcohol preferably has an average polymerization degree of 500 or higher but lower than 4,000. The diacetone-modified polyvinyl alcohol with an average polymerization degree of 500 or higher has sufficiently long molecular chains, and entwinement of the chains with each other can retain coating solution components. Thus, the coating solution for forming the protective layer is prevented from permeating into the heat-sensitive recording layer during the coating and drying steps, and thereby a favorable coat can be formed on the heat-sensitive recording layer. In this case, the effects of the prescribed water content also can be fully exhibited. In the case where the average polymerization degree is lower than 500, coating solution components tend not to be sufficiently retained. Thus, an increased amount of the coating solution permeates into the heat-sensitive recording layer during the coating and drying steps, and the formation of a favorable coat may be difficult. The diacetone-modified polyvinyl alcohol with an average polymerization degree of lower than 4,000 has a good water solubility and can prevent a rapid increase in viscosity of the coating solution caused by the crosslinking reaction with the crosslinker. Thus, the stability of the coating solution is increased. In the case where the average polymerization degree is 4,000 or higher, the diacetone-modified polyvinyl alcohol has a lower water solubility and may cause a rapid increase in viscosity of the coating solution through the crosslinking reaction. Thus, the stability of the coating solution may be decreased. The average polymerization degree is more preferably 1,000 or higher but lower than 2,000. In this range, a more favorable coat can be formed on the heat-sensitive recording layer, and the stability of the coating solution is further increased. The average polymerization degree can be measured according to the test method specified in JIS K6726.

Furthermore, the diacetone-modified polyvinyl alcohol used for the present invention preferably has a saponification degree of 80% or higher but lower than 98%. Since the crystallinity of the diacetone-modified polyvinyl alcohol with a saponification degree of lower than 98% is not so high, the volumetric shrinkage of the coat at the drying step for forming the protective layer can be effectively suppressed. Thus, a uniform coat with a fewer microcracks generated by the shrinkage can be formed, and a better solvent barrier property can be obtained. Further, since such a diacetone-modified polyvinyl alcohol increases the flexibility of the coat, the thermal recording material is less prone to powder spill. In the case where the diacetone-modified polyvinyl alcohol has a saponification degree of 98% or higher, the coat is prone to microcrack generation and the solvent barrier property tends to be decreased. Also, the formed coat may be hard and fragile due to less flexibility, and therefore the thermal recording material may be more prone to powder spill. Since the diacetone-modified polyvinyl alcohol with a saponification degree of 80% or higher has a high water solubility, the coating solution is highly stable. Since the diacetone-modified polyvinyl alcohol with a saponification degree of lower than 80% tends to have a lower water solubility, the stability of the coating solution may be decreased. The saponification degree is more preferably 90% or higher but lower than 98%. This is because such a diacetone-modified polyvinyl alcohol, due to its better water solubility, further increases the stability of the coating solution; and provides a good solvent barrier property due to effective suppression of the volumetric shrinkage of the coat at the drying step. The saponification degree can be measured according to the test method specified in JIS K6726. According to the present invention, the diacetone-modified polyvinyl alcohol content of the protective layer is preferably 40 to 90 mass %, and particularly preferably 50 to 80 mass % relative to the total solid content of the protective layer.

The protective layer of the present invention contains a crosslinker at least together with the diacetone-modified polyvinyl alcohol. Examples of the crosslinker of the present invention include hydrazide compounds; aldehyde compounds such as glyoxal and 2,2-dimethoxyethanal; urea resins; methylol compounds such as a melamine resin and a phenol resin; compounds having an epichlorohydrin residue, which are exemplified by a polyamide epichlorohydrin resin; epoxy compounds such as a polyfunctional epoxy resin; isocyanate compounds such as polyisocyanate compounds and blocked isocyanate compounds; and oxidizers such as persulfates and peroxides. These compounds can be used alone or in combination thereof.

As the crosslinker of the present invention, hydrazide compounds are preferably used. This is because, through a crosslinking reaction, a hydrazide compound forms a strong bond to a crosslinkable carbonyl group in the diacetone-modified polyvinyl alcohol and thereby a high water resistance can be obtained after completion of the reaction. Specific examples of the hydrazide compound include adipic acid dihydrazide, isophthalic acid dihydrazide, terephthalic acid dihydrazide, dodecanedioic acid dihydrazide, oxalic acid dihydrazide, malonic acid dihydrazide, succinic acid dihydrazide, glutaric acid dihydrazide, sebacic acid dihydrazide, maleic acid dihydrazide, fumaric acid dihydrazide, itaconic acid dihydrazide and poly(meth)acrylic acid hydrazide. Inter alia, adipic acid dihydrazide is particularly preferred. This is because, after formation of the protective layer, the crosslinking reaction of adipic acid dihydrazide with the diacetone-modified polyvinyl alcohol smoothly proceeds under the conditions that the water content is kept at 6% or higher, and tends to increase the wet-blocking resistance with time, but does not cause discoloration etc.

The amount of the crosslinker to be used is preferably 0.5 to 30 mass %, and particularly preferably 5 to 15 mass % relative to the diacetone-modified polyvinyl alcohol. In the case where the amount of the crosslinker is in this range, the crosslinking reaction uniformly proceeds. Thus, the solvent barrier property of the protective layer is increased, powder spill can be prevented and the wet-blocking resistance is increased. In addition, a uniform coat can be formed. In the case where the crosslinker content is below the above-mentioned range, due to less localization of the crosslinking reaction, the solvent barrier property is increased and powder spill can be prevented, but the wet-blocking resistance tends to be insufficient. On the other hand, in the case where the crosslinker content is above the above-mentioned range, the wet-blocking resistance is sufficient, but since an uneven coat is formed by an excessive crosslinking reaction, the solvent barrier property tends to be poor and powder spill is increased.

The protective layer of the present invention can contain a pigment. Examples of the pigment include inorganic pigments such as diatomite, talc, kaolin, calcined kaolin, heavy calcium carbonate, light calcium carbonate, magnesium carbonate, zinc oxide, aluminum oxide, aluminum hydroxide, magnesium hydroxide, titanium dioxide, barium sulfate, zinc sulfate, amorphous silica, amorphous calcium silicate and colloidal silica; and organic pigments such as a melamine resin, a urea-formalin resin, polyethylene, nylon, a styrene plastic pigment, an acrylic plastic pigment and a hydrocarbon plastic pigment. These pigments can be used alone or in combination thereof.

Inter alia, kaolin is particularly preferred since it provides the protective layer with a further increased surface strength, solvent barrier property, etc. Kaolin has a good affinity with both of the ethylene-vinyl alcohol copolymer and the diacetone-modified polyvinyl alcohol, and also has a tabular structure. Thus, kaolin densely covers the surface of the heat-sensitive recording layer at the coating and drying steps for forming the protective layer, and increases the contact area of the heat-sensitive recording layer with the protective layer; and strongly binds in the interface to both of the ethylene-vinyl alcohol copolymer in the heat-sensitive recording layer, and the diacetone-modified polyvinyl alcohol in the protective layer. Therefore, the thermal recording material has a further increased surface strength. In addition, since kaolin prevents water from permeating into the heat-sensitive recording layer during the coating and drying steps for forming the protective layer, and enables prolonged retention of water in the protective layer at the drying step, the crosslinking reaction of the diacetone-modified polyvinyl alcohol proceeds slowly. Through such a slow progress, crosslinks are formed evenly among molecules, and the formed coat has crosslinks more evenly. As a result, the wet-blocking resistance and the solvent barrier property is further increased. The pigment content of the protective layer of the present invention is not particularly limited as long as the effects of the present invention can be achieved, but is preferably 5 to 50 mass %, and more preferably 15 to 50 mass % relative to the total solid content of the protective layer.

According to the present invention, the kind of kaolin is not particularly limited as long as the effects of the present invention can be achieved, but preferred is a kaolin with an average particle diameter of 0.1 to 3 μm, and more preferably 0.2 to 0.6 μm. The average particle diameter used here is determined by the laser diffraction particle size distribution analysis. The kaolin with an average particle diameter of 0.2 to 0.6 μm covers the surface of the heat-sensitive recording layer more densely, and further promotes strong binding between the ethylene-vinyl alcohol copolymer and the diacetone-modified polyvinyl alcohol. Therefore, the thermal recording material has a further increased surface strength. The aspect ratio of kaolin is preferably 5 to 50, and more preferably 10 to 30. The kaolin with an aspect ratio of 10 to 30 covers the surface of the heat-sensitive recording layer more densely, and further promotes strong binding between the ethylene-vinyl alcohol copolymer and the diacetone-modified polyvinyl alcohol. Therefore, the thermal recording material has a further increased surface strength. In addition, the kaolin with such a high aspect ratio makes the surface of the protective layer smoother, and therefore, the thermal recording material has an increased coloring sensitivity and saturated print density. Furthermore, since the kaolin covers the heat-sensitive recording layer more densely, water is prevented from permeating into the heat-sensitive recording layer during the coating and drying steps for forming the protective layer. Thus, the formed coat has crosslinks more evenly, and as a result, the wet-blocking resistance and the solvent barrier property is further increased.

According to the present invention, the aspect ratio refers to the average diameter/thickness value of 100 particles randomly sampled in an electron-microscopic image of a powder material. The higher the aspect ratio, the more the oblateness.

The protective layer of the present invention preferably contains silica as another pigment together with kaolin. Examples of the silica include amorphous silica, amorphous calcium silicate and colloidal silica. The combined use of kaolin and silica can further increase the wet-blocking resistance and further reduce powder spill upon cutting operation. Due to its high water absorbability, silica can absorb water on the surface of the protective layer (such water may cause wet-blocking) and thereby prevents wet-blocking itself. Therefore, the thermal recording material has a further increased wet-blocking resistance. Also, since silica differs from kaolin in the particle form, the combined use inhibits unnecessary orientation of kaolin and makes the protective layer more flexible. Therefore, the thermal recording material is further less prone to powder spill upon cutting operation. In the case where silica is used alone or in combination with a pigment other than kaolin, densely covering the surface of the heat-sensitive recording layer at the drying step may be unsuccessful, and in some cases, the solvent barrier property and the surface strength are not sufficiently increased. According to the present invention, the ratio of silica to kaolin is not particularly limited as long as the effects of the present invention can be achieved, but is preferably 10 to 100 mass %, and particularly preferably 30 to 60 mass %.

According to the present invention, the kind of silica is not particularly limited as long as the effects of the present invention can be achieved, but preferred is a silica with an average particle diameter of 0.01 to 5 μm, and more preferably 0.02 to 1 μm. The average particle diameter used here is determined by the laser diffraction particle size distribution analysis. The silica with an average particle diameter of 0.02 to 1 μm more effectively inhibits unnecessary orientation of kaolin in the protective layer and makes the protective layer more flexible. Therefore, the thermal recording material is further less prone to powder spill upon cutting operation.

If needed, the protective layer, like the heat-sensitive recording layer, may contain lubricants such as higher fatty acid metal salts, higher fatty acid amides, paraffin, polyolefin, oxidized polyethylene and castor wax for improvement in sticking property etc.; ultraviolet absorbers such as benzophenone or benzotriazole series compounds for improvement in light resistance etc.; surfactants such as high-molecular-weight anionic or nonionic surfactants for improvement in dispersion and spreadability, etc.; and in addition, fluorescent brighteners, color modifiers, defoamants, etc. Also, a moisturizer is preferably contained so that the prescribed water content of the protective layer can be kept for a certain time.

The protective layer of the present invention may be a monolayer, or be composed of two or more layers. In the case of the protective layer composed of two or more layers, respective protective layers may differ from each other in chemical composition and the like, but preferably, a diacetone-modified polyvinyl alcohol is contained at least in the protective layer adjacent to the heat-sensitive recording layer.

Usually, the protective layer of the present invention can be formed according to a known technique, like the heat-sensitive recording layer. A coating solution for forming the protective layer is prepared by mixing an aqueous solution containing a diacetone-modified polyvinyl alcohol and an aqueous solution containing a crosslinker, and if needed, an aqueous dispersion containing a finely-ground pigment etc. and an aqueous solution containing another additive etc. The crosslinker is added preferably at the latest possible timing in the preparation of the coating solution since the crosslinker reacts with the diacetone-modified polyvinyl alcohol even in the coating solution. In the case of the protective layer composed of two or more layers, alternate coating and drying for each layer; successive coating and subsequent drying for all the layers; or simultaneous coating and subsequent drying for all the layers may be performed. Similarly, successive coating for the heat-sensitive recording layer and the protective layer and subsequent drying, or simultaneous coating for both layers and subsequent drying may be performed. The bone-dry coating amount for the protective layer is preferably 0.2 to 10 $g/m^2$, and more preferably 1 to 5 $g/m^2$. The drying conditions can be appropriately adjusted as far as the heat-sensitive recording layer does not color.

As the support of the present invention, any of paper, various woven cloths, a nonwoven cloth, a synthetic resin film, a synthetic resin laminated paper, a synthetic paper, a metallic foil, a vapor deposition sheet and a composite sheet having the foregoing materials combined by adhesion etc., can be used depending on the purpose. Inter alia, paper, such as acid-free paper and acid paper, is preferably used since the water content is easy to control.

In the thermal recording material of the present invention, one or more interlayers can be provided between the support and the heat-sensitive recording layer if needed, for example, for the purpose of increasing the coloring sensitivity. In addition, one or more backcoat layers, such as a magnetic recording layer, an antistatic layer and an adhesive layer, can be provided on the back side of the support, i.e. the side not having the heat-sensitive recording layer, etc.

The support and any layer can contain a pigment together with an adhesive. Examples of the pigment include inorganic pigments such as diatomite, talc, kaolin, calcined kaolin, heavy calcium carbonate, light calcium carbonate, magnesium carbonate, zinc oxide, aluminum oxide, aluminum hydroxide, magnesium hydroxide, titanium dioxide, barium sulfate, zinc sulfate, amorphous silica, amorphous calcium silicate and colloidal silica; organic pigments such as a melamine resin, a urea-formalin resin, polyethylene, nylon, a styrene plastic pigment, an acrylic plastic pigment and a hydrocarbon plastic pigment; and hollow sphere organic pigments.

As the pigment used for the interlayer, calcined kaolin and/or a hollow sphere organic pigment is particularly preferred. Either of them, due to the high heat insulation property, provides the thermal recording material with an excellent thermal responsiveness. A hollow sphere organic pigment, which contains air in the hollow, provides the thermal recording material with a higher heat insulation property. Also, a hollow sphere organic pigment, which is in an approximately globular form, can be densely arranged without impairing the flexibility of the layer, and thereby provides the interlayer with a high strength and flexibility. Therefore, the thermal recording material has a further excellent thermal responsiveness and surface strength, and is further less prone to powder spill.

According to the present invention, the hollow sphere organic pigment refers to a resin pigment having a closed space therein, and more specifically, a homopolymer having, as a main component, a monomer unit such as vinyl chloride, vinylidene chloride, vinyl acetate, styrene, methyl acrylate, ethyl acrylate, butyl acrylate, acrylonitrile, methyl methacrylate, ethyl methacrylate, butyl methacrylate, methacrylonitrile and the like; a copolymer having two or more kinds of the foregoing monomers; or the like. The hollow sphere organic pigment used for the present invention is not particularly limited as long as the effects of the present invention can be achieved, but preferred is a hollow sphere organic pigment with an average particle diameter of 0.1 to 5 μm, and more preferably 0.5 to 2 μm. The average particle diameter used here is determined by the laser diffraction particle size distribution analysis. The hollow sphere organic pigment content is preferably 3 to 80 mass % relative to the total solid content of the interlayer.

Any layer, such as the interlayer, can contain any kind of resin as an adhesive. Specific examples of the resin include starch, hydroxyethyl cellulose, methyl cellulose, ethyl cellulose, carboxymethylcellulose, gelatin, casein, polyvinyl alcohol, a modified polyvinyl alcohol such as a sulfone-modified polyvinyl alcohol, polyacrylic acid, polymethacrylic acid, a polyacrylic acid ester, a polymethacrylic acid ester, sodium polyacrylate, polyethylene terephthalate, polybutylene terephthalate, chlorinated polyether, an allyl resin, a furan resin, a ketone resin, oxybenzoylpolyester, polyacetal, polyether ether ketone, polyether sulfone, polyimide, polyamide, polyamideimide, polyaminobismaleimide, polymethylpentene, polyphenylene oxide, polyphenylene sulfide, polyphenylene sulfone, polysulfone, polyarylate, polyallylsulfone, polybutadiene, polycarbonate, polyethylene, polypropylene, polystyrene, polyvinyl chloride, polyvinylidene chloride, polyvinyl acetate, polyurethane, a phenol resin, a urea resin, a melamine resin, a melamine-formalin resin, a benzoguanamine resin, a bismaleimide-triazine resin, an alkyd resin, an amino resin, an epoxy resin, an unsaturated polyester resin, a styrene/butadiene copolymer, an acrylonitrile/butadiene copolymer, a methyl acrylate/butadiene copolymer, an ethylene/vinyl acetate copolymer, an acrylamide/acrylic acid ester copolymer, an acrylamide/acrylic acid ester/methacrylic acid terpolymer, an alkali salt of a styrene/maleic anhydride copolymer, an alkali or ammonium salt of an ethylene/maleic anhydride copolymer, and various polyolefin resins. These resins may be used with the ethylene-vinyl alcohol copolymer in the heat-sensitive recording layer, and may be used with the diacetone-modified polyvinyl alcohol in the protective layer.

According to the present invention, the support and any layer may contain, in addition to the pigment and the resin exemplified above, if needed, water-miscible organic solvents such as lower alcohols and cellosolve, and surfactants such as high-molecular-weight anionic or nonionic surfactants for improvement in dispersion and spreadability, etc.; and in addition, fluorescent brighteners, color modifiers, defoamants, etc. Also, a moisturizer may be contained so that the prescribed water content of the thermal recording material can be kept for a certain time.

The interlayer or various backcoat layers can be formed according to a known technique without any particular limitation. Specifically, a coating solution is applied by a technique selected from film press coating, air knife coating, rod blade coating, bar coating, blade coating, gravure coating, curtain coating, extrusion bar coating and the like, and then dried to form the objective layer. Layer formation can be also achieved, for example, by use of various printers of lithographic type, letterpress type, flexographic type, gravure type, screen type, hotmelt type and other types. Furthermore, alternate coating and drying for each layer; successive coating and subsequent drying for all the layers; or simultaneous coating and subsequent drying for all the layers may be performed. The bone-dry coating amount for the interlayer is preferably 1 to 30 g/m$^2$, and more preferably 3 to 20 g/m$^2$. The bone-dry coating amounts for the different backcoat layers are appropriately selected depending on the function required of each layer, and the like.

After coating for forming the interlayer, the heat-sensitive recording layer, the protective layer or the backcoat layer, supercalendering can be performed for improvement in print quality, if needed.

EXAMPLES

Hereinafter, the present invention will be illustrated by Examples in more detail, but is not limited thereto. In the following examples, "parts" and "%" are each on the mass basis, and the coating amount denotes the bone-dry coating amount.

Example 1

(1) Preparation of Coating Solution for Forming Interlayer

A mixture of 50 parts of calcined kaolin [manufactured by BASF, trade name: Ansilex], 200 parts of a hollow sphere organic pigment dispersion with a solid content of 27.5% [manufactured by Rohm & Haas Company, trade name: Ropaque HP91], 40 parts of a 50% styrene-butadiene latex, 50 parts of a 10% aqueous oxidized starch solution, and 100 parts of water was stirred, and thus, a coating solution for forming the interlayer was prepared.

(2) Preparation of Coating Solution for Forming Heat-Sensitive Recording Layer Part 1

The mixtures (A), (B) and (C) shown below were separately ground by Dyno-Mill (a sand mill manufactured by WAB) so that the volume-average particle diameter was 1 μm or smaller, and thus, respective dispersions were obtained.

(A) Dye Precursor Dispersion

| | |
|---|---|
| 3-Dibutylamino-6-methyl-7-anilinofluoran | 30 parts |
| 2.5% Aqueous sulfone-modified polyvinyl alcohol solution | 69 parts |
| 1% Aqueous acetyleneglycol surfactant solution | 1 part |

(B) Electron-Accepting Compound Dispersion

| | |
|---|---|
| 4,4'-Dihydroxydiphenylsulfone | 30 parts |
| 2.5% Aqueous sulfone-modified polyvinyl alcohol solution | 69 parts |
| 1% Aqueous acetyleneglycol surfactant solution | 1 part |

(C) Pigment and Sensitizer Dispersion

| | |
|---|---|
| Aluminum hydroxide [manufactured by Showa Denko K.K., trade name: HIGILITE H42] | 50 parts |
| Benzyl-2-naphthyl ether | 30 parts |
| 2.5% Aqueous sulfone-modified polyvinyl alcohol solution | 199 parts |
| 1% Aqueous acetyleneglycol surfactant solution | 1 part |

(3) Preparation of Coating Solution for Forming Heat-Sensitive Recording Layer

Part 2

Next, a solid ethylene-vinyl alcohol copolymer with a viscosity-average polymerization degree of 380 and a saponification degree of 99.1% (both measured according to JIS K6726) was dispersed in water, and the dispersion was stirred at 90° C. for 2 hours. Thus, a 10% aqueous solution of the copolymer was prepared as an aqueous solution (A).

(4) Preparation of Coating Solution for Forming Heat-Sensitive Recording Layer

Part 3

Further, the dispersions (A), (B) and (C) and the aqueous solution (A) were mixed with the other components shown below, and the mixture was stirred. Thus, a coating solution for forming the heat-sensitive recording layer was prepared.

| | |
|---|---|
| (A) Dye precursor dispersion | 100 parts |
| (B) Electron-accepting compound dispersion | 100 parts |
| (C) Pigment and sensitizer dispersion | 280 parts |
| 30% Aqueous zinc stearate dispersion [manufactured by Chukyo Yushi Co., Ltd., trade name: Hidorin Z-7-30] | 25 parts |
| 40% Aqueous methylol stearamide dispersion | 25 parts |
| 20% Aqueous paraffin wax dispersion | 25 parts |
| Aqueous solution (A) | 220 parts |
| Water | 100 parts |

(5) Preparation of Coating Solution for Forming Protective Layer

A coating solution for forming the protective layer was prepared in the following compounding ratio.

| | |
|---|---|
| 10% Aqueous solution of a diacetone-modified polyvinyl-alcohol [manufactured by JAPAN VAM & POVAL CO., LTD., trade name: DM-17] | 50 parts |
| 30% Aqueous dispersion of aluminum hydroxide [manufactured by Showa Denko K.K., trade name: HIGILITE H42] | 10 parts |
| 30% Aqueous zinc stearate dispersion [manufactured by Chukyo Yushi Co., Ltd., trade name: Hidorin Z-7-30] | 6 parts |
| 5% Aqueous adipic acid dihydrazide solution | 10 parts |
| Water | 50 parts |

(6) Production of Thermal Recording Material

For formation of the different layers on an acid-free high-quality roll paper with a basis weight of 66 g/m$^2$, respective coating solutions were applied by an air-knife coater and dried by an air floating dryer, so that the solid coating amount was 5 g/m$^2$ for the interlayer, 0.5 g/m$^2$ for the heat-sensitive recording layer in terms of the dye precursor, and 3 g/m$^2$ for the protective layer. Then, calendering was performed to give a thermal recording material. The water content of the calendered thermal recording material just before take-up was measured online with a contactless near-infrared moisture meter, and based on the measurement feedback, the drying conditions (the temperature and amount of air) were adjusted so that the water content at the point of take-up was 5.5%. The obtained roll with the desired water content was kept in a sealed condition for 1 hour.

Example 2

The same procedures as described in Example 1 were performed to give a thermal recording material, except for adjusting the drying conditions so that the water content at the point of take-up was 6.5% before keeping the obtained roll in a sealed condition for 1 hour in (6) Production of thermal recording material.

Example 3

The same procedures as described in Example 1 were performed to give a thermal recording material, except for adjusting the drying conditions so that the water content at the point of take-up was 11% before keeping the obtained roll in a sealed condition for 1 hour in (6) Production of thermal recording material.

Example 4

The same procedures as described in Example 1 were performed to give a thermal recording material, except for adjusting the drying conditions so that the water content at the point of take-up was 6.5% before keeping the obtained roll in a sealed condition for 24 hours in (6) Production of thermal recording material.

Example 5

The same procedures as described in Example 1 were performed to give a thermal recording material, except for adjusting the drying conditions so that the water content at the point of take-up was 10% before keeping the obtained roll in a sealed condition for 1 hour in (6) Production of thermal recording material.

Example 6

The same procedures as described in Example 1 were performed to give a thermal recording material, except for mixing and stirring the dispersions, the aqueous solution and water in the following compounding ratio in (4) Preparation of coating solution for forming heat-sensitive recording layer—Part 3—.

| | |
|---|---|
| (A) Dye precursor dispersion | 100 parts |
| (B) Electron-accepting compound dispersion | 100 parts |
| (C) Pigment and sensitizer dispersion | 280 parts |
| 30% Aqueous zinc stearate dispersion [manufactured by Chukyo Yushi Co., Ltd., trade name: Hidorin Z-7-30] | 25 parts |
| 40% Aqueous methylol stearamide dispersion | 25 parts |
| 20% Aqueous paraffin wax dispersion | 25 parts |
| Aqueous solution (A) | 330 parts |
| Water | 50 parts |

Example 7

The same procedures as described in Example 1 were performed to give a thermal recording material, except for using a solid ethylene-vinyl alcohol copolymer with a viscosity-average polymerization degree of 500 and a saponification degree of 98%, instead of the solid ethylene-vinyl alcohol copolymer with a viscosity-average polymerization degree of 380 and a saponification degree of 99.1% in (3) Preparation of coating solution for forming heat-sensitive recording layer—Part 2—. The viscosity-average polymerization degree and the saponification degree were measured according to JIS K6726.

Example 8

The same procedures as described in Example 1 were performed to give a thermal recording material, except for using a solid ethylene-vinyl alcohol copolymer with a viscosity-average polymerization degree of 4,000 and a saponification degree of 98%, instead of the solid ethylene-vinyl alcohol copolymer with a viscosity-average polymerization degree of 380 and a saponification degree of 99.1% in (3) Preparation of coating solution for forming heat-sensitive recording layer—Part 2—. The viscosity-average polymerization degree and the saponification degree were measured according to JIS K6726.

Example 9

The same procedures as described in Example 1 were performed to give a thermal recording material, except for using a solid ethylene-vinyl alcohol copolymer with a viscosity-average polymerization degree of 1,700 and a saponification degree of 89%, instead of the solid ethylene-vinyl alcohol copolymer with a viscosity-average polymerization degree of 380 and a saponification degree of 99.1% in (3) Preparation of coating solution for forming heat-sensitive recording layer—Part 2—. The viscosity-average polymerization degree and the saponification degree were measured according to JIS K6726.

Example 10

The same procedures as described in Example 1 were performed to give a thermal recording material, except for using a solid ethylene-vinyl alcohol copolymer with a viscosity-average polymerization degree of 1,700 and a saponification degree of 98%, instead of the solid ethylene-vinyl alcohol copolymer with a viscosity-average polymerization degree of 380 and a saponification degree of 99.1% in (3) Preparation of coating solution for forming heat-sensitive recording layer—Part 2—. The viscosity-average polymerization degree and the saponification degree were measured according to JIS K6726.

Example 11

The same procedures as described in Example 1 were performed to give a thermal recording material, except for using 10 parts of a 30% aqueous dispersion of kaolin [manufactured by J. M. Huber Corporation, trade name: HG90], instead of 10 parts of the 30% aqueous dispersion of aluminum hydroxide [manufactured by Showa Denko K. K., trade name: HIGILITE H42] in (5) Preparation of coating solution for forming protective layer.

Example 12

The same procedures as described in Example 1 were performed to give a thermal recording material, except for using 7 parts of a 30% aqueous dispersion of kaolin [manufactured by J. M. Huber Corporation, trade name: HG90] and 3 parts of a 30% aqueous dispersion of silica [manufactured by Mizusawa Industrial Chemicals, LTD., trade name: MIZUKASIL P527], instead of 10 parts of the 30% aqueous dispersion of aluminum hydroxide [manufactured by Showa Denko K. K., trade name: HIGILITE H42] in (5) Preparation of coating solution for forming protective layer.

Example 13

The same procedures as described in Example 1 were performed to give a thermal recording material, except for the followings.

(i) using a solid ethylene-vinyl alcohol copolymer with a viscosity-average polymerization degree of 1,700 and a saponification degree of 98%, instead of the solid ethylene-vinyl alcohol copolymer with a viscosity-average polymerization degree of 380 and a saponification degree of 99.1% in (3) Preparation of coating solution for forming heat-sensitive recording layer—Part 2—. The viscosity-average polymerization degree and the saponification degree were measured according to JIS K6726.

(ii) mixing and stirring the dispersions, the aqueous solution and water in the following compounding ratio in (4) Preparation of coating solution for forming heat-sensitive recording layer—Part 3—

| | |
|---|---|
| (A) Dye precursor dispersion | 100 parts |
| (B) Electron-accepting compound dispersion | 100 parts |
| (C) Pigment and sensitizer dispersion | 280 parts |
| 30% Aqueous zinc stearate dispersion [manufactured by Chukyo Yushi Co., Ltd., trade name: Hidorin Z-7-30] | 25 parts |
| 40% Aqueous methylol stearamide dispersion | 25 parts |
| 20% Aqueous paraffin wax dispersion | 25 parts |
| Aqueous solution (A) | 330 parts |
| Water | 50 parts |

(iii) using the coating solution prepared in Example 10, as a coating solution for forming the protective layer in (5) Preparation of coating solution for forming protective layer (iv) adjusting the drying conditions so that the water content at the point of take-up was 6.5% before keeping the obtained roll in a sealed condition for 24 hours in (6) Production of thermal recording material Comparative Example 1

The same procedures as described in Example 1 were performed to give a thermal recording material, except for using a solid diacetone-modified polyvinyl-alcohol [JAPAN VAM & POVAL CO., LTD., trade name: DM-17], instead of the solid ethylene-vinyl alcohol copolymer with a viscosity-average polymerization degree of 380 and a saponification degree of 99.1% in (3) Preparation of coating solution for forming heat-sensitive recording layer—Part 2—. The viscosity-average polymerization degree and the saponification degree were measured according to JIS K6726.

Comparative Example 2

The same procedures as described in Comparative Example 1 were performed to give a thermal recording material, except for adjusting the drying conditions so that the water content at the point of take-up was 6.5% before keeping the obtained roll in a sealed condition for 1 hour in the step for production of a thermal recording material.

Comparative Example 3

The same procedures as described in Example 1 were performed to give a thermal recording material, except for using a solid diacetone-modified polyvinyl-alcohol [JAPAN VAM & POVAL CO., LTD., trade name: DM-17], instead of the solid ethylene-vinyl alcohol copolymer with a viscosity-average polymerization degree of 380 and a saponification degree of 99.1% in (3) Preparation of coating solution for forming heat-sensitive recording layer—Part 2—, and for using 50 parts of a 10% aqueous solution of an ethylene-vinyl alcohol copolymer with a viscosity-average polymerization degree of 380 and a saponification degree of 99.1%, instead of 50 parts of the 10% aqueous solution of a diacetone-modified polyvinyl-alcohol [JAPAN VAM & POVAL CO., LTD., trade name: DM-17] in (5) Preparation of coating solution for forming protective layer. The viscosity-average polymerization degree and the saponification degree were measured according to JIS K6726.

Comparative Example 4

The same procedures as described in Comparative Example 3 were performed to give a thermal recording material, except for adjusting the drying conditions so that the water content at the point of take-up was 6.5% before keeping the obtained roll in a sealed condition for 1 hour in the step for production of a thermal recording material.

Comparative Example 5

The same procedures as described in Example 1 were performed to give a thermal recording material, except for using 125 parts of a 20% aqueous dispersion of an acrylic resin [manufactured by Mitsui Chemicals, Inc., trade name: BARIASTAR B1000] and 225 parts of water, instead of 250 parts of the aqueous solution (A) and 100 parts of water in (4) Preparation of coating solution for forming heat-sensitive recording layer—Part 3—.

Comparative Example 6

The same procedures as described in Comparative Example 5 were performed to give a thermal recording material, except for adjusting the drying conditions so that the water content at the point of take-up was 6.5% before keeping the obtained roll in a sealed condition for 1 hour in the step for production of a thermal recording material.

Comparative Example 7

The same procedures as described in Example 1 were performed to give a thermal recording material, except for using 50 parts of a 10% aqueous solution of an ethylene-vinyl alcohol copolymer with a viscosity-average polymerization degree of 380 and a saponification degree of 99.1%, instead of 50 parts of the 10% aqueous solution of a diacetone-modified polyvinyl-alcohol [JAPAN VAM & POVAL CO., LTD., trade name: DM-17] in (5) Preparation of coating solution for forming protective layer. The viscosity-average polymerization degree and the saponification degree were measured according to JIS K6726.

Comparative Example 8

The same procedures as described in Comparative Example 7 were performed to give a thermal recording material, except for adjusting the drying conditions so that the water content at the point of take-up was 6.5% before keeping the obtained roll in a sealed condition for 1 hour in the step for production of a thermal recording material.

Comparative Example 9

The same procedures as described in Example 1 were performed to give a thermal recording material, except for using 25 parts of a 20% aqueous dispersion of an acrylic resin [manufactured by Mitsui Chemicals, Inc., trade name: BARIASTAR B1000] and 75 parts of water, instead of 50 parts of the 10% aqueous solution of a diacetone-modified polyvinyl-alcohol [JAPAN VAM & POVAL CO., LTD., trade name: DM-17] and 50 parts of water in (5) Preparation of coating solution for forming protective layer.

Comparative Example 10

The same procedures as described in Comparative Example 9 were performed to give a thermal recording material, except for adjusting the drying conditions so that the water content at the point of take-up was 6.5% before keeping the obtained roll in a sealed condition for 1 hour in the step for production of a thermal recording material.

Comparative Example 11

The same procedures as described in Comparative Example 7 were performed to give a thermal recording material, except for adjusting the drying conditions so that the water content at the point of take-up was 13% before keeping the obtained roll in a sealed condition for 1 hour in the step for production of a thermal recording material.

After being kept sealed for the prescribed duration, the thermal recording materials produced in Examples 1 to 13 and Comparative Examples 1 to 10 were unsealed in a constant humidity room. Then, the thermal recording materials were rerolled with adjustment of the water content to 5%, and the evaluations shown below were performed. The thermal recording material produced in Comparative Example 11 failed to be evaluated since blocking of the back and front surfaces of the material already occurred before rerolling. The results are shown in Table 1.

[Wet-Blocking Resistance]

From each of the produced thermal recording materials, two sample pieces sized 5 cm×5 cm were cut out. Two drops of water were put on the protective layer surface of one of the pieces, and the other piece was overlaid thereon so that both protective layer surfaces faced each other. The combined pieces were allowed to stand with a load of 3 kg applied thereon in an atmosphere of 40° C. and 90% RH for 24 hours. Then, the both pieces were stripped from each other and the degree of sticking of the protective layers was evaluated as a measure of the water resistance. In addition, the stripped sample pieces were placed in an oven at 130° C. for 10 minutes to allow color development on the entire surface, and the degree of peel-off (white spots) caused by the sticking was evaluated by visual observation. The evaluation criteria used are as follows.

Excellent: The protective layers do not stick together, the pieces are easily stripped from each other, and no peel-off (no white spots) is observed.

Good: The protective layers slightly stick together, but no peel-off is observed.

Fair: The protective layers slightly stick together, but peel-off is hardly observed.

Poor: The protective layers stick together, peel-off is observed a little, and no good for practical use Very poor: The protective layers stick together, and peel-off is extensively observed.

[Powder Spill]

Printing-cutting operation was repeated 1,000 times on each of the produced thermal recording materials by use of a thermal printer with an automatic cutter (manufactured by Seiko Epson Corp., model number: TM-T88II). Then, powder spilled inside the printer (in the vicinity of the rolled paper loading unit) was collected and weighed for evaluation. The evaluation criteria used are as follows.

Excellent: The amount of powder spill is less than 1 mg.

Good: The amount of powder spill is 1 mg or more but less than 5 mg.

Fair: The amount of powder spill is 5 mg or more but less than 10 mg.

Poor: The amount of powder spill is 10 mg or more but less than 50 mg.

Very poor: The amount of powder spill is 50 mg or more.

[Solvent Barrier Property]

Against the protective layer surface of each of the produced thermal recording materials, a piece of cloth permeated with 5 ml of a mixed solvent containing 4 parts of toluene and 6 parts of ethyl acetate was rubbed 5 times by weak force. Then, the degree of color development on the surface of each thermal recording material was evaluated. The evaluation criteria used are as follows.

Excellent: No color development is observed.

Fair: Color development is hardly observed.

Poor: Color development is observed with a time lag after the contact of the mixed solvent.

Very poor: Color development is observed immediately after the contact of the mixed solvent.

[Surface Strength]

Each of the produced thermal recording materials was evaluated for the surface strength by use of an RI printability tester (manufactured by IHI Machinery and Furnace Co., Ltd., model: RI-1) and ink for the picking test (manufactured by DIC Corporation, trade name: FINE INK for picking test TV. 30). The printing conditions were set at a rotation speed of 100 rpm and an ink volume of 0.4 cc. The evaluation criteria used are as follows.

Excellent: No picking is observed.

Good: Picking is hardly observed.

Fair: Picking is observed a little, but no problems in practical use.

Poor: Picking is observed.

Very poor: A great amount of picking is observed.

[Thermal Print]

On each of the produced thermal recording materials, printing was performed by use of a facsimile tester (manufactured by Okura Engineering Co., LTD., model number: TH-PMD). The tester was equipped with a thermal head featuring a dot density of 8 dots/mm and a head resistance of 1,685Ω, and black solid printing and letter printing were performed at an applied voltage of 20 V and at applied pulse-widths of 1.0 and 1.4 msec. The print density was measured with Macbeth reflection densitometer model RD-918 (visual filter) (manufactured by Macbeth). The evaluation criteria used are as follows.

Excellent: The reflection density of the printed area upon printing at a pulse-width of 1.0 msec is 1.2 or higher.

Fair: The reflection density of the printed area upon printing at a pulse-width of 1.0 msec is lower than 1.2, and the reflection density of the printed area upon printing at a pulse-width of 1.4 msec is 1.2 or higher.

Poor: The reflection density of the printed area upon printing at a pulse-width of 1.4 msec is lower than 1.2.

Very poor: No color development is observed.

TABLE 1

| | Wet-blocking resistance | Powder spill | Solvent barrier property | Surface strength | Thermal print |
|---|---|---|---|---|---|
| Ex 1 | F | F | F | F | F |
| Ex 2 | G | G | F | F | F |
| Ex 3 | E | G | F | F | F |
| Ex 4 | E | E | F | F | F |
| Ex 5 | E | E | F | F | F |
| Ex 6 | F | E | F | E | F |
| Ex 7 | F | G | F | G | F |
| Ex 8 | F | G | F | G | F |
| Ex 9 | F | G | F | G | F |
| Ex 10 | F | E | F | E | F |
| Ex 11 | G | G | E | F | E |
| Ex 12 | E | E | F | F | F |
| Ex 13 | E | E | E | E | F |
| CEx 1 | VP | P | P | P | F |
| CEx 2 | P | P | P | P | F |
| CEx 3 | VP | P | P | F | P |
| CEx 4 | VP | F | P | F | P |
| CEx 5 | P | VP | VP | VP | P |
| CEx 6 | P | P | VP | VP | P |
| CEx 7 | VP | F | P | F | F |
| CEx 8 | VP | F | P | F | F |
| CEx 9 | F | VP | VP | VP | P |
| CEx 10 | F | VP | VP | VP | P |
| CEx 11 | NE | NE | NE | NE | NE |

Ex: Example
CEx: Comparative Example
E: Excellent
G: Good
F: Fair
P: Poor
VP: Very poor
NE: Non-evaluable As clearly shown in Table 1, the thermal recording materials of Examples 1 to 13 were more excellent in wet-blocking resistance, solvent barrier property, surface strength and thermal print (sensitivity), and caused less powder spill upon cutting operation, compared with those of Comparative Examples 1 to 6. The former contain an ethylene-vinyl alcohol copolymer in the heat-sensitive recording layer and contain a diacetone-modified polyvinyl alcohol in the protective layer, while the latter contain no ethylene-vinyl alcohol copolymer in the heat-sensitive recording layer at least. The thermal recording materials of Comparative Examples 7 and 8 were inferior in solvent barrier property and wet-blocking resistance, compared with those of Examples 1 to 13. The former contain an ethylene-vinyl alcohol copolymer instead of a diacetone-modified polyvinyl alcohol in the protective layer. The thermal recording materials of Comparative Examples 9 and 10 were inferior in solvent barrier property, surface strength, sensitivity and powder spill prevention, compared with those of Examples 1 to 13. The former contain an acrylic resin instead of a diacetone-modified polyvinyl alcohol in the protective layer.

The thermal recording materials of Examples 2 and 3, which were kept with the water content being 6% or higher but lower than 12%, showed a more excellent wet-blocking resistance and less powder spill, compared with those of Example 1. The thermal recording materials of Examples 4 and 5, which were kept with the water content being 6% or higher but lower than 8% for 24 hours or longer and with the water content being 9% or higher but lower than 11% for 1 hour or longer, respectively, showed a more excellent wet-blocking resistance and less powder spill, compared with those of Examples 2 and 3.

The thermal recording material of Example 6, which contains 15 mass % or higher of an ethylene-vinyl alcohol copolymer in the heat-sensitive recording layer, showed a more excellent surface strength and less powder spill, compared with those of Example 1. The thermal recording materials of Examples 7, 9 and 10, which each contain an ethylene-vinyl alcohol copolymer with an average polymerization degree of 500 or higher but lower than 4,000 in the heat-sensitive recording layer, showed a more excellent surface strength and less powder spill, compared with those of Example 1. The thermal recording materials of Examples 7, 8 and 10, which each contain an ethylene-vinyl alcohol copolymer with a saponification degree of 90% or higher but lower than 99% in the heat-sensitive recording layer, showed a more excellent surface strength and less powder spill, compared with those of Example 1. The thermal recording material of Example 10, which contains an ethylene-vinyl alcohol copolymer with an average polymerization degree of 1,000 or higher but lower than 2,000 and a saponification degree of 95% or higher but lower than 99% in the heat-sensitive recording layer, showed a more excellent surface strength and less powder spill, compared with those of Example 7.

The thermal recording material of Example 11, which contains kaolin in the protective layer, showed a more excellent solvent barrier property and sensitivity, compared with those of Examples 1 to 10. The thermal recording material of Example 12, which contains kaolin and silica in the protective layer, showed a more excellent wet-blocking resistance and less powder spill, compared with those of Example 11. The thermal recording material of Example 13 contains 15 mass % or higher of an ethylene-vinyl alcohol copolymer with an average polymerization degree of 1,000 or higher but lower than 2,000 and a saponification degree of 95% or higher but lower than 99% in the heat-sensitive recording layer, contains kaolin and silica in the protective layer, and was kept with the water content being 6% or higher but lower than 8% for 24 hours or longer. This thermal recording material showed a more excellent surface strength and solvent barrier property, compared with those of Example 12.

The invention claimed is:

1. A thermal recording material comprising a heat-sensitive recording layer that forms color upon application of heat and a protective layer stacked in this order on a support, the heat-sensitive recording layer comprising an ethylene-vinyl alcohol copolymer and the protective layer comprising a diacetone-modified polyvinyl alcohol and a crosslinker, wherein the thermal recording material is produced by applying and drying a coating solution for forming the protective layer on the heat-sensitive recording layer provided on the support, said thermal recording material having an overall water content of at least 6% but lower than 12%.

2. The thermal recording material according to claim 1, wherein the thermal recording material is produced by maintaining the overall water content of a layered product obtained by applying and drying said coating solution on said heat-sensitive recording layer formed on its support at 6% or higher but lower than 8% for at least 24 hours, or at 9% or higher but lower than 11% for at least 1 hour.

3. The thermal recording material according to any one of claims 1 to 2, wherein the ethylene-vinyl alcohol copolymer content of the heat-sensitive recording layer is 15 mass % or higher relative to the total solid content of the heat-sensitive recording layer.

4. The thermal recording material according to claim 3, wherein the average polymerization degree of the ethylene-vinyl alcohol copolymer is 500 or higher but lower than 4,000 and the saponification degree thereof is 90% or higher but lower than 99%.

5. The thermal recording material according to claim 4, wherein the protective layer contains kaolin.

6. The thermal recording material according to claim 5, wherein the protective layer further contains silica.

7. A method for producing a thermal recording material comprising a heat-sensitive recording layer for color formation by heat and a protective layer stacked successively on a support, the method comprising the steps of:

applying and drying a coating solution for forming the protective layer on the heat-sensitive recording layer formed on the support, the coating solution containing a diacetone-modified polyvinyl alcohol and a crosslinker; and maintaining the overall water content of a thus-obtained layered product at 6% or higher but lower than 12%, the layered product comprising the heat-sensitive recording layer and the protective layer stacked on the support.

8. The method according to claim 7, wherein the overall water content of the layered product after the drying step is maintained at 6% or higher but lower than 8% for at least 24 hours, or at 9% or higher but lower than 11% for at least 1 hour.

* * * * *